US009947300B2

(12) United States Patent
Altavilla

(10) Patent No.: US 9,947,300 B2
(45) Date of Patent: Apr. 17, 2018

(54) ERGONOMIC MUSICAL INSTRUMENT PLECTRUM

(71) Applicant: THE TONECAT COMPANY

(72) Inventor: Keith Altavilla, Riverside, IL (US)

(73) Assignee: THE TONECAT COMPANY, Cincinnati, OH (US)

( * ) Notice: Subject to any disclaimer, the term of this patent is extended or adjusted under 35 U.S.C. 154(b) by 0 days.

(21) Appl. No.: 15/123,875

(22) PCT Filed: Mar. 6, 2015

(86) PCT No.: PCT/US2015/019168
§ 371 (c)(1),
(2) Date: Sep. 6, 2016

(87) PCT Pub. No.: WO2015/134868
PCT Pub. Date: Sep. 11, 2015

(65) Prior Publication Data

US 2017/0084254 A1 Mar. 23, 2017

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | | |
|---|---|---|---|---|---|
| 1,184,561 | A | | 5/1916 | Napoletano | |
| 1,254,577 | A | | 1/1918 | Carpenter et al. | |
| 1,263,740 | A | | 4/1918 | Burdwise | |
| 1,461,070 | A | | 7/1923 | Rudesyle | |
| 2,170,179 | A | | 8/1939 | Wolcott | |
| 2,459,274 | A | * | 1/1949 | Galetzky | G10D 3/163 84/320 |
| 2,484,820 | A | * | 10/1949 | Galetzky | G10D 3/163 84/322 |
| 3,112,668 | A | | 12/1963 | Moshay | |
| 3,319,505 | A | * | 5/1967 | Galetzky | G10D 3/163 84/322 |
| 4,253,372 | A | * | 3/1981 | Filipetti | G10D 3/163 84/322 |
| 4,347,773 | A | * | 9/1982 | Zook | G10D 3/163 84/322 |
| 4,625,615 | A | * | 12/1986 | Lukehart | G10D 3/163 84/322 |
| 4,993,302 | A | | 2/1991 | Jonathan | |
| 5,587,542 | A | | 12/1996 | Everly | |
| 5,859,377 | A | | 1/1999 | Mackey et al. | |
| 6,346,662 | B1 | * | 2/2002 | Sielaff | G10D 3/163 84/320 |
| 7,067,729 | B2 | * | 6/2006 | Leong | G10D 3/163 84/320 |

(Continued)

*Primary Examiner* — Robert W Horn
(74) *Attorney, Agent, or Firm* — Greenblum & Bernstein, P.L.C.

(57) ABSTRACT

A musical instrument plectrum having at least two string-engaging regions (17, 18), an incurvate contact surface (13) on a first side of the plectrum, and an obverse contact surface (35) on a second side of the plectrum. The incurvate contact surface (13) is arranged so that two of the at least two string-engaging regions (17, 18) are noncontiguous with each other.

24 Claims, 8 Drawing Sheets

(56) References Cited

U.S. PATENT DOCUMENTS

| | | | | |
|---|---|---|---|---|
| 7,238,869 | B1 * | 7/2007 | Kleckzka | G10D 3/163 84/320 |
| 7,375,268 | B1 * | 5/2008 | Thornhill | G10D 3/163 84/315 |
| 7,427,705 | B2 * | 9/2008 | Rubens | G10D 3/163 84/320 |
| 7,462,768 | B2 * | 12/2008 | Newmaster | G10D 3/163 84/320 |
| 7,683,245 | B2 | 3/2010 | Judd | |
| 8,019,130 | B2 * | 9/2011 | Aletto | G06K 9/00885 283/67 |
| 8,664,498 | B2 * | 3/2014 | Leneman | G10D 3/163 84/322 |
| 9,691,365 | B2 * | 6/2017 | Pascale | G10D 3/163 |
| 2005/0211053 | A1 * | 9/2005 | Ball | G10D 3/163 84/322 |
| 2013/0092008 | A1 | 4/2013 | Murphy | |
| 2016/0071499 | A1 * | 3/2016 | Wardwell | G10D 3/163 84/322 |
| 2017/0084254 | A1 * | 3/2017 | Altavilla | G10D 3/163 |

* cited by examiner

ERGONOMIC MUSICAL INSTRUMENT PLECTRUM

CROSS-REFERENCE TO RELATED APPLICATION

The present application claims the benefit of U.S. Provisional Application No. 61/949,920 filed on Mar. 7, 2014, the disclosure of which is expressly incorporated by reference herein in its entirety.

BACKGROUND OF THE DISCLOSURE

Field of the Disclosure

The present disclosure relates to a plectrum, or pick, used to engage the strings of a musical instrument. More specifically, the disclosure relates to plectra having an ergonomic feature providing a physical impedance bridge between gripping digits.

Description of the Related Art

The modern stringed instrument flat pick has been used to engage the strings of musical instruments for nearly a century. Most picks are made from thin flat stock out of which a profile is punched out. Over the years, myriad profiles and radii have been tailored to best suit the needs of players and the nature of particular instruments. Many materials have been used for this purpose, and their relative stiffness or flexibility is usually communicated through a declaration of their thickness dimension. The pick's flatness is accommodating.

The ordinary flat pick offers little guidance, save for the perimeter of the available gripping surface, in directing the fingertips to any particular place on the pick, which allows players at every level of competence the freedom to hold the pick as best suits their particular physiology, technique and preference.

The ordinary flat pick, however, suffers from a number of drawbacks. Ideally, a pick is to be held between digits (e.g., a thumb and a finger) while maintaining loose but controlled hand and forearm tension so that the player can engage the strings accurately, smoothly and with less fatigue. The flat pick, however, must be gripped quite firmly to prevent slippage or rotation in order to engage the string of a musical instrument in a controlled manner.

All flat picks can suffer from the same drawbacks, regardless of the perimeter profile of a pick, namely, the pick can rotate upon its center of mass, or "spin" between the digits unless gripped firmly, and flat picks can slip out of a preferred position easily, or drop from the hand, for example, once the fingers become moist with sweat, or if a player lessens their grip.

Changing between ordinary flat picks of different thicknesses also poses problems for players. If a player wants a stiffer playing pick, for example, he or she typically chooses a pick of greater thickness. Gripping a pick that is thicker or thinner than what the user has become accustomed to, however, changes the positional relationship between the tendons of the hand and forearm, thereby requiring an adjustment period for the brain to accommodate the changes in extension and/or flexion caused by the distance variance between the gripping digits. With some flat picks a feature has been added to aid in gripping the pick. A history of centralized feature placement on the pick as the assumed general player preference, however, directs the digits to the only place the player can put his or her fingers to realize the benefit of the feature design.

Modest efforts have been made to improve flat pick grip-ability and resistance to rotation between the thumb and an opposing digit. Most improvements have involved the placement of a feature that was designed to minimize rotation and/or slippage. Additional grip elements have been introduced, purporting to improve comfort and control.

With all of these approaches, however, feature placement was determinate. With these designs, a deliberate decision was made to direct the fingers to the feature. The approaches made use of prominent hard boundaries, which limits the efficacy of the feature if the dictated finger position is not employed. With a hard boundary, the feature is centrally located, such that the feature is surrounded by a planar portion of the pick. With such a centrally located feature, the entire perimeter of the pick lies in a common plane. This demand causes many players to alter their style and does not accommodate player preferences, regardless of whether the technique employed by the player meets established and accepted traditions and standards, or is highly individualized.

Therefore a need exists to provide players with an improved plectrum.

SUMMARY OF EMBODIMENTS OF THE DISCLOSURE

Aspects of embodiments of the disclosure are directed to a musical instrument plectrum, comprising: an incurvate contact surface conveyed by a suitable geometric solid shape to the first, or reverse side of the plectrum, and; a suitable contact surface conveyed to the second, or obverse, side of the plectrum, the contact surface may be a convex relief, the prominence of which may rise from the obverse plane of the string engaging area, the rise may be limited by the thickness of the string engaging area, wherein the contact surfaces are employable as a physical impedance bridge ergonomically coupling the engaging digits.

In further embodiments, the plectrum further comprises: a contact surface, wherein a region of the surface has the same dimension through its thickness as each plectrum that shares embodiments of the disclosure, irrespective of the thickness of the string engaging area.

In further embodiments, the plectrum, further comprises: a textured pattern structured and arranged to mimic human fingerprint ridge characteristics, the pattern further comprising at least one of: fingerprint inter-ridge spacing, fingerprint ridge depth, and fingerprint ridge orientation.

In further embodiments, the plectrum further comprises: a contact surface wherein at least one border of the contact surface is non-directive in its ability to guide the gripping digits, unlike the other borders of the contact surface.

In further embodiments, the plectrum further comprises: a plane of a string engaging area that is non-contiguous with a plane of any other co-planar string engaging area.

Additional aspects of embodiments of the disclosure are directed to an indication system that conveys information about the physical properties and performance characteristics of plectra comprising at least one of: a density rating, a hardness rating, a flexibility rating, an appearance rating, and other properties, wherein the product of the system is applied to at least one of: packaging, promotion, labeling, advertising, decoration, multimedia, education, training, and marketing.

Aspects of embodiments of the disclosure are directed to a musical instrument plectrum having at least two string-engaging regions, an incurvate contact surface on a first side of the plectrum, and an obverse contact surface on a second side of the plectrum. The incurvate contact surface is arranged so that two of the at least two string-engaging regions are noncontiguous with each other.

In embodiments, a shape of the obverse contact surface corresponds with a shape of the incurvate contact surface.

In further embodiments, the obverse contact surface has approximately the same shape as that of the incurvate contact surface.

In additional embodiments, the obverse contact surface has approximately the same radius of curvature as that of the incurvate contact surface.

In yet further embodiments, the obverse contact surface extends beyond a planar surface of the at least two string-engaging regions on the second side of the plectrum.

In embodiments, the obverse contact surface is a planar surface coplanar with surfaces of the at least two string-engaging regions on the second side of the plectrum.

In further embodiments, the incurvate contact surface on the first side of the plectrum extends to side edges of the plectrum.

In additional embodiments, portions of a perimeter edge of the plectrum are not co-planar with remaining portions of the perimeter edge of the plectrum.

In yet further embodiments, the instrument plectrum includes a spherical-planar intersection at one or more edges of the plectrum.

In yet further embodiments, the spherical-planar intersection at one or more edges of the plectrum is formed by an intersection of the incurvate contact surface on a first side of the plectrum with one of the at least two planar regions.

In embodiments, the instrument plectrum includes a curved profile at one or more side edges of the plectrum.

In further embodiments, the incurvate contact surface comprises a concave shape.

In additional embodiments, the obverse contact surface comprises a convex shape.

In embodiments, the instrument plectrum includes a textured surface feature comprising a plurality of fingerprint ridge engagement elements, a height of which approximates an average fingerprint ridge depth.

In further embodiments, the plurality of fingerprint ridge engagement elements are spaced from one another as a multiple or divisional of an average human fingerprint ridge-to-ridge distance.

In additional embodiments, the plurality of fingerprint ridge engagement elements are aligned parallel to a longitudinal axis of the plectrum.

In yet further embodiments, the plurality of fingerprint ridge engagement elements are aligned parallel to a fingerprint orientation.

In additional embodiments, the at least two string-engaging regions are planar regions.

Additional aspects of the present disclosure are directed to a plurality of musical instrument plectrums, each having at least two string-engaging regions, an incurvate contact surface on a first side of the plectrum, and an obverse contact surface on a second side of the plectrum. The incurvate contact surface and the obverse contact surface together forming gripping contact areas. A thickness exists between the incurvate contact surface and the obverse contact surface in a region of gripping contact areas. The incurvate contact surface is arranged so that two of the at least two string-engaging regions are noncontiguous with each other. Each of the plurality of musical instrument plectrums has differing structural characteristics. The thickness in the region of gripping contact area is the same for each of the plurality of musical instrument plectrums.

In embodiments, the differing structural characteristics comprise different plectrum thicknesses of one or more of the string engaging areas of the respective plectrums.

In further embodiments, the differing structural characteristics comprise different materials of the respective plectrums.

In additional embodiments, the differing structural characteristics comprise different stiffnesses of the respective plectrums.

In yet further embodiments, the method comprising forming the musical instrument plectrum in a mold that is structured and arranged to form the incurvate contact surface on the first side of the plectrum.

Additional aspects of the present disclosure are directed to a method of making the musical instrument plectrum having at least two string-engaging regions, an incurvate contact surface on a first side of the plectrum, and an obverse contact surface on a second side of the plectrum, wherein the incurvate contact surface is arranged so that two of the at least two string-engaging regions are noncontiguous with each other. The method includes molding the musical instrument plectrum in a mold that is structured and arranged to form the incurvate contact surface on the first side of the plectrum.

Additional aspects of the present disclosure are directed to a method of quantifying one or more properties of a musical instrument plectrum. The method includes describing at least one of a density of the plectrum, a hardness of the plectrum, and a flexibility of the plectrum.

In embodiments, the method further includes associating a physical appearance of the plectrum with the particular properties of the plectrum, so that the physical appearance of the plectrum is indicative of at least one of the density of the plectrum, the hardness of the plectrum, and the flexibility of the plectrum.

In further embodiments, the physical appearance comprises one of an opaque appearance, a pearlescent appearance, a sparkly appearance, and an at least partially transparent appearance.

Additional aspects of the present disclosure are directed to a musical instrument plectrum, comprising at least one string-engaging region and an incurvate contact surface on a first side of the plectrum. The incurvate contact surface on the first side of the plectrum extends to side edges of the plectrum, such that portions of a perimeter edge of the plectrum are not co-planar with remaining portions of the perimeter edge of the plectrum.

In embodiments, at least one border of the incurvate contact surface extends to side edges of the plectrum so that the incurvate contact surface is non-directive in its ability to guide the gripping digits.

In further embodiments, the at least one border of the incurvate contact surface extends to side edges of the plectrum such that the incurvate contact surface accommodates multiple positions of a gripping digit within the incurvate contact surface including locating the gripping digit at the side edge of the plectrum.

BRIEF DESCRIPTION OF THE SEVERAL VIEWS OF THE DRAWINGS

The present disclosure is further described in the detailed description which follows, in reference to the noted plurality of drawings by way of non-limiting examples of exemplary embodiments of the present disclosure, in which like reference numerals represent similar parts throughout the several views of the drawings, and wherein.

DETAILED DESCRIPTION OF EMBODIMENTS OF THE DISCLOSURE

Figure 1:
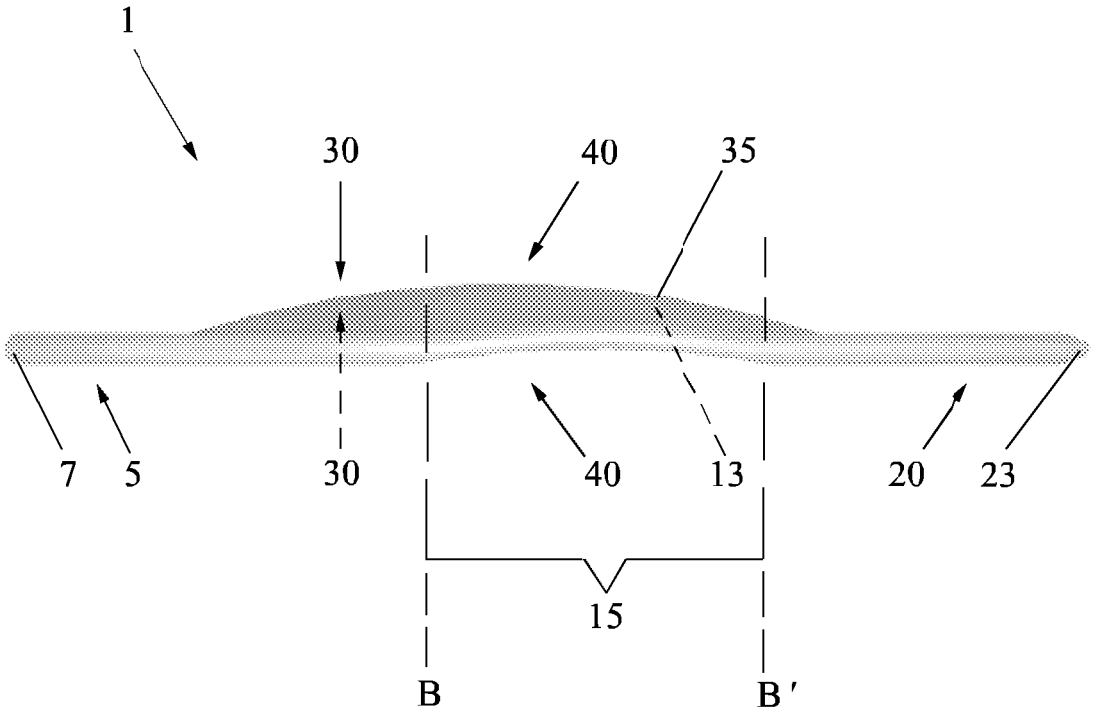
FIG. 1 shows a side view of an exemplary plectrum with an obverse side prominence in accordance with aspects of embodiments of the disclosure.

In the following description, the various embodiments of the present disclosure will be described with respect to the enclosed drawings.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description is taken with the drawings making apparent to those skilled in the art how the forms of the present disclosure may be embodied in practice. As should be understood, the exemplary representations may not be drawn to scale in order to more clearly illustrate aspects of the present disclosure.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities (e.g., thickness dimensions) used in the specification and claims are to be understood as being modified in all instances by the term "about." Accordingly, unless indicated to the contrary, the numerical parameters set forth in the specification and claims are approximations that may vary depending upon the desired properties sought to be obtained by the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range. For example, if a range is from about 1 to about 50, it is deemed to include, for example, 1, 7, 34, 46.1, 23.7, or any other value or range within the range.

The various embodiments disclosed herein can be used separately and in various combinations unless specifically stated to the contrary.

Players who find their specific grip techniques or habits incompatible with picks having known gripping features often return to using an ordinary flat pick, and then have to manage with the legacy of flat pick design shortcomings by tightly squeezing the flat pick to maintain control. Squeezing tightly increases muscle flexion in the hand and forearm, making the implementation of various arpeggiation techniques more difficult to execute. The increased tension also fatigues the muscles and stresses the tendons of the hand and forearm. With hard boundary features of the conventional flat pick, the player is attempting to couple three dimensional entities (his or her finger and thumb) through what is essentially a two dimensional entity (the flat pick) such that the player and the pick are inefficiently coupled. In such a manner, a physical impedance mismatch is present.

Aspects of the embodiments of the present disclosure are directed to an improved plectrum (or pick) that is ergonomically coupled to the player, acting as a physical impedance bridge between it and the digits of the hand. With embodiments of the present disclosure, the player is free to grip the plectrum in the manner to which they are accustomed, yet they are rewarded with a plectrum that requires less grip force to control effectively and offers resistance to slippage and rotation. Embodiments of the disclosure allow the fingertips to experience a consistent thickness dimension through the depth of the contact surface, irrespective of the thickness of the string engaging area. By implementing the embodiments of the present disclosure, positional relationships, as experienced by the muscles and tendons of the hand and forearm, are maintained. In embodiments of the disclosure, plectrums may be configured to have different relative flexibility (not by changing the contiguous thickness of the plectrum, as is the tradition), but through offering multiple configurations of the pick made with materials having specific and/or differing physical characteristics. In an embodiment, a group of picks can be offered with a consistent thickness dimension through the depth of the contact surface, and a thickness of the string engaging areas, wherein each pick in the group is made from a different material. Therein, the user is provided with picks of uniform string engaging thickness, and consistent contact surface thickness. The different characteristics, including flexibility, of whichever material is employed are what give the user a different feel and sound that is unique to that particular material. In another embodiment, a group of picks can be offered with a consistent thickness dimension through the depth of the contact surface, and each pick in the group being made of the same particular material, wherein each pick in the group has a different uniform thickness through the string engaging areas. Therein, the user is provided with material characteristic constancy and a consistent gripping contact area thickness. Flexibility options are exercised by choosing a pick with string engaging areas that are thicker or thinner than the other plectra in the group. Further aspects of embodiments of the present disclosure are directed to a system for efficiently and objectively comparing the performance characteristics of the different configurations of the disclosure. In embodiments, the system employs simple declarative language to communicate information about relative density, hardness, flexibility, and/or appearance, amongst other information. In embodiments of the disclosure, several different string engaging profiles may be incorporated into the pick to accommodate player needs and preferences, with suitable offerings possessing, for example, one or more string engaging areas of different profile and/or thickness.

The embodiments of this disclosure do not require adherence to any particular shape of pick outline. Prior art dating back to the early $20^{th}$ century illustrates myriad pick outlines, many of which can benefit from the application of this disclosure to their thickness profile. Acknowledging such, and without limiting the present disclosure, illustrations of the embodiments of this disclosure are built upon an exemplary pick outline, the D'ANDREA® 351®, also known as the FENDER®, medium pick, which will be referred to as a 'standard' outline. The outline is substantially shown as the plectrum 2 in FIG. 8. The outline approximates that of an isosceles triangle with both legs (or sides) of the triangle longer than the base, a height of approximately 25 mm from base to vertex, two congruent base angles having a broad radius, and one angle at the vertex with a narrow radius. The embodiments of the present disclosure will be implemented upon this exemplary and non-limiting pick shape (or outline). (Fender® is a registered trademark of Fender Musical Instruments Corporation. D'Andrea®, and 351® are registered trademarks of D'Andrea USA.)

Aspects of the embodiments of the present disclosure are directed to a musical instrument plectrum that is employed as a physical impedance bridge between it and the gripping digits of the picking hand.

An aspect of the embodiments of the present disclosure takes into consideration that the bones and joints in the human hand are primarily comprised of a relatively simple combination of cylindrical and spheroid skeletal elements. A view across the fleshy pad of the user's thumb, the distal end pointed towards ones' own eyes, reveals a decidedly semi-circular contour, as does the view of the thumb crossing the line of sight perpendicularly. A plectrum according to the embodiments of the present disclosure accommodates the natural curves of the gripping digits.

An additional aspect for embodiments of the present disclosure takes into consideration that the grip between finger and thumb presses soft tissues between bony cylindrical and spheroid skeletal elements. In embodiments of the present disclosure, a suitable shape, for example, of a geometric solid, typically spheroid, and in a preferred embodiment, a prolate spheroid, is provided (e.g., impressed) upon the thickness of the plectrum to accommodate the even distribution of soft tissue pressure across the bony cylindrical and spheroid skeletal elements of the digits, and provide a larger area of surface contact between the digits and the plectrum.

A further aspect of embodiments of the present disclosure takes into consideration that the plectrum should accommodate the players grip in a manner that minimizes the grip force required to effectively engage the pick.

An additional aspect of embodiments of the present disclosure takes into consideration that the plectrum should easily resist radial rotation once the player has grasped it.

Embodiments of the disclosure incorporate one or more of the above noted features. FIG. 1 shows a side view of an exemplary plectrum 1 in accordance with aspects of embodiments of the disclosure. The obverse contact surface 35 of the plectrum displays a convex aspect. While not visible in FIG. 1, in embodiments, the pick includes a correspondingly incurvate contact surface 13 (shown in FIG. 2). In embodiments, the term "correspondingly" may include approximately same shapes or similar shapes as discussed below. One string engaging area 5 with a broader radius 7 at the base of the plectrum is shown on the left. A string engaging area 20 with a narrower radius 23 at the vertex of the plectrum is displayed on the right. The plectrum 1 is structured to provide a profile 15 at the spherical-planar intersection (between B and B') at one or more edges of the plectrum 1 that, for example, resembles a curve (e.g., a platykurtic data distribution curve). With the exemplary plectrum 1, the profile 15 is provided on two legs of the exemplary triangular plectrum (only visible on one leg in FIG. 1). The profile 15 provides a suitable shape for the spherical-planar intersection of the plectrum in accordance with aspects of the disclosure. The profile 15 aids with gripping the pick, extending a non-directing border of the gripping contact area 40 to the edge of the plectrum 1. In embodiments, the gripping contact area 40 (or at least a region 37 (shown in FIGS. 5-7) of gripping contact area 40) has a measured thickness 30 (shown in FIGS. 5-7) that is commonly shared with each plectrum, (e.g., of a set of plectrums) irrespective of the thickness of the string engaging area.

Figure 2:
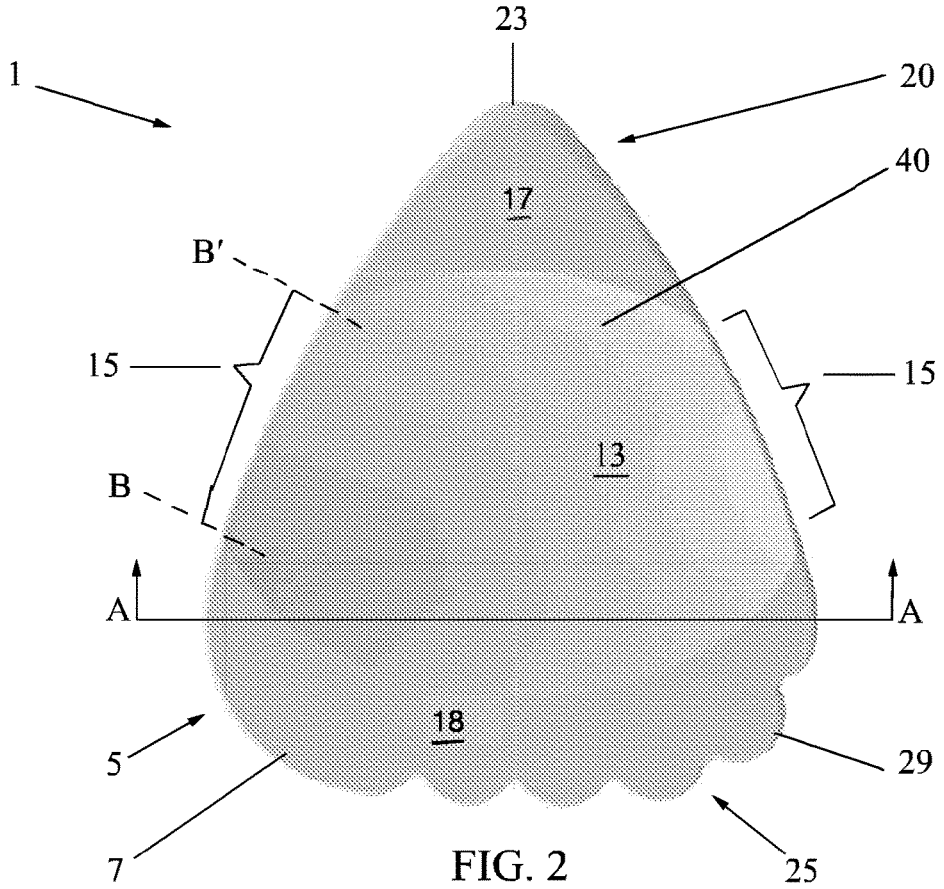
FIG. 2 is a plan view of the reverse side of an exemplary plectrum in accordance with aspects of embodiments of the disclosure.

FIG. 2 is a plan view of an exemplary plectrum 1. This reverse view of the plectrum displays an incurvate contact surface 13. As should be understood, the obverse contact surface 35 (not visible in FIG. 2) is opposite the incurvate contact surface 13. As shown in FIG. 2, in embodiments, the pick (or plectrum) includes: a string engaging area 5 with a broader radius 7 at the base of the plectrum 1; a scalloped string engaging area 25 at the base of the plectrum 1; and a string engaging area 20 with a narrower radius 23 at the vertex of the plectrum 1. The location of the profile 15 of the intersection (between B and B') that resembles, in an exemplary embodiment, a spherical-planar intersection, is arranged at both sides of the exemplary triangular plectrum. In accordance with embodiments of the disclosure, the profile 15 occurs at the intersection of the gripping contact area 40 and the approximate edge of the plectrum. The location of segment A-A is illustrated through the incurvate contact surface 13.

Figure 3:
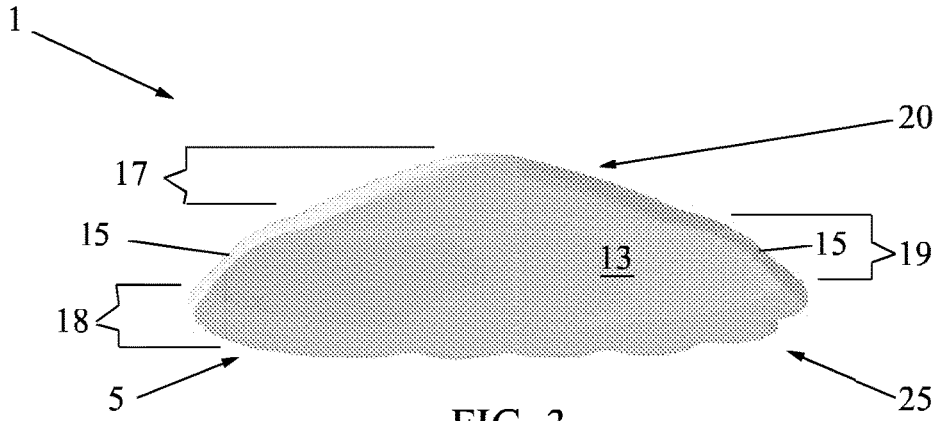
FIG. 3 is a perspective view of the reverse side of an exemplary plectrum in accordance with aspects of embodiments of the disclosure.

FIG. 3 is a bottom perspective view of an exemplary plectrum 1. As shown in FIG. 3, the incurvate contact surface 13 forms a curve through a portion of the plectrum 1, (e.g., at the median of the legs of the plectrum) that renders a plane of the string engaging areas non-contiguous. That is, the gripping contact area 40 (having the incurvate contact surface 13) divides the pick into two approximately planar regions 17 and 18 (also shown in FIG. 2) that are separated by the curved region 19.

Figure 4:
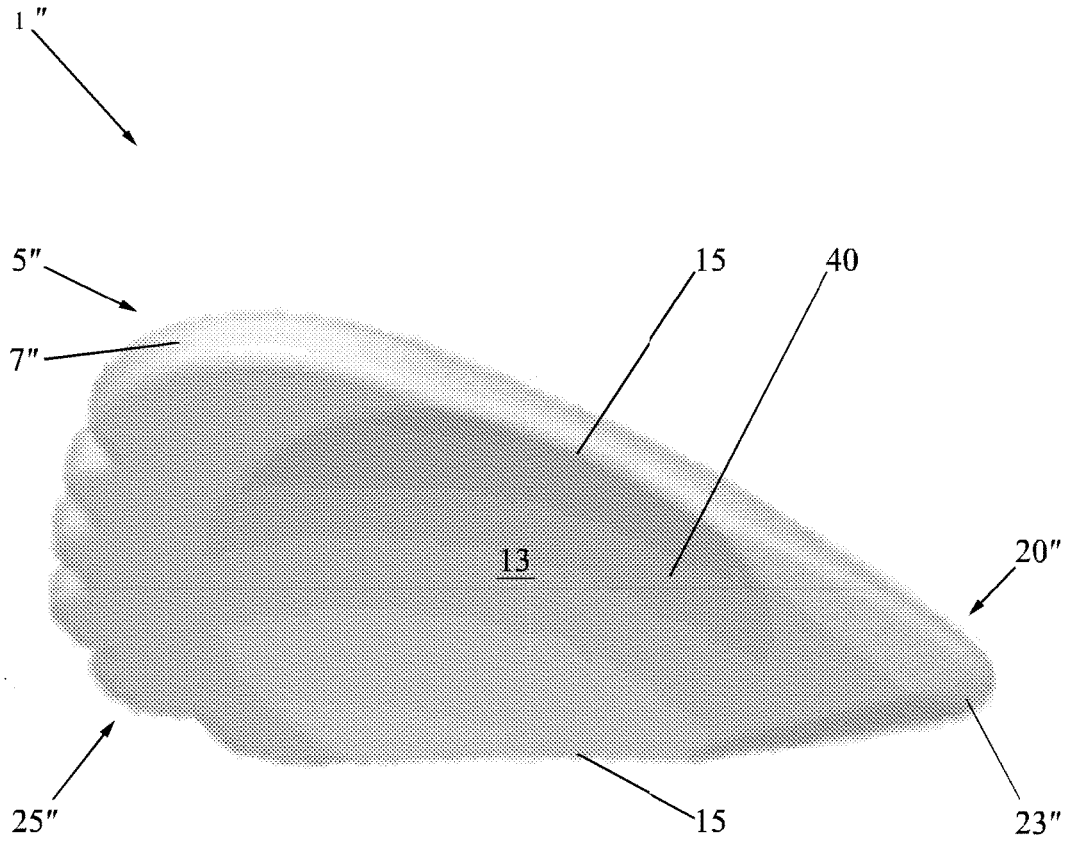
FIG. 4 is an alternative perspective view of the reverse side of an exemplary thicker plectrum in accordance with aspects of embodiments of the disclosure.

FIG. 4 is an side-bottom perspective view of an exemplary relatively thicker plectrum 1". In embodiments of the disclosure, as shown in FIG. 4, the incurvate contact surface 13, is structured and arranged to accentuate the appearance of a suitable solid geometric shape conveyed to the reverse side of the plectrum. As shown in FIG. 4, the plectrum 1" includes a thicker string engaging area 5" with a broader radius 7" at the base of the plectrum, a thicker scalloped string engaging area 25" at the base of the plectrum, and a thicker string engaging area 20" with a narrower radius 23" at the vertex of the plectrum.

Figures 5, 6, 7:
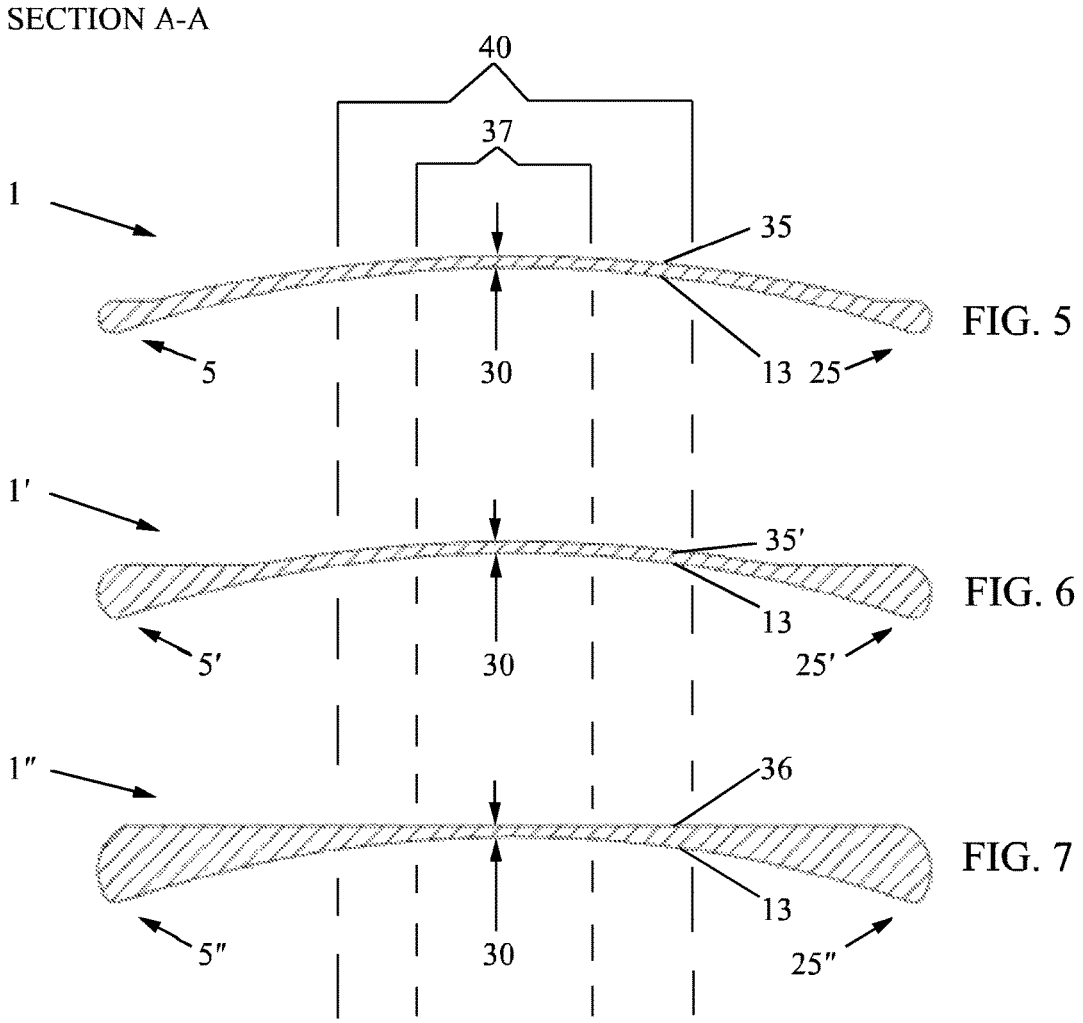
FIG. 5 displays an enlarged cross-sectional view of an exemplary thinner plectrum taken along a segment of FIG. 2 through a region of the gripping contact area in accordance with aspects of embodiments of the disclosure.
FIG. 6 displays an enlarged cross-sectional view of an exemplary medium thickness plectrum taken along a segment, through a region of the gripping contact area in accordance with aspects of embodiments of the disclosure.
FIG. 7 displays an enlarged cross-sectional view of an exemplary thicker plectrum taken along a segment, through a region of the gripping contact area in accordance with aspects of embodiments of the disclosure.

Referring to FIGS. 2 and 3, in an exemplary embodiment, upon the first, or reverse, side of the plectrum, an incurvate contact surface is imparted (e.g., pressed, formed, molded) by a suitable geometric solid shape (e.g., a prolate spheroid) so that the resulting incurvate contact surface 13 can efficiently accommodate the outwardly curved surface of the distal end of an engaging digit (e.g., thumb or index finger). Referring to FIG. 1, in embodiments, the obverse contact surface 35, displays a correspondingly convex shape on the second, or obverse, side of the plectrum, its convex curves presenting a surface to be gripped by an opposing digit. In embodiments, correspondingly may include approximately the same shape or similar shapes as discussed below. In embodiments, the obverse contact surface 35 may be convex, and may have approximately the same radius as the incurvate contact surface 13. Both surfaces are corresponding, at least through a region of the gripping area, in that they share a relative position opposite each other, and in their shape via the equal value of their respective radii through at least one axis. In other embodiments, the obverse contact surface 35 may be convex and may have a different radius than the incurvate contact surface 13. Both surfaces correspond in that they share a relative position opposite each other, and they both have a radius, however, they do not share the same radius. Referring to FIG. 7, in an alternative embodiment, the alternative obverse contact surface 36 may be planar. The surfaces correspond at least through a region of the gripping area, in that they share a relative position opposite each other, however with this embodiment, there is no radial similarity between the two surfaces.

Referring to FIG. 2, by implementing aspects of embodiments of the disclosure, the gripping contact area 40 is structured and arranged to correspond with the curves of a user's digits (e.g., the curves of an average user's digit). In accordance with embodiments of the disclosure, the gripping contact area 40 achieves a greater increase in surface area contact by efficiently coupling more of the outwardly curved surface of the distal end of an engaging digit to the inwardly curved surface of the incurvate contact surface 13 than can be accomplished with a flat pick, without any additional gripping pressure applied (as compared to a flat pick). The even distribution of finger tissue contact with the plectrum minimizes the grip force required to effectively engage the pick. In an embodiment, the orientation of the shape of the gripping contact area 40 is such that its major axis is oriented transverse the legs exemplary approximately triangular plectrum 1. This aligns well with how most people orient the conjugate axis of their thumb parallel with an imaginary line between the midpoint of the base, and the narrower radius 23 at the vertex of the pick, the distal end of the thumb pointing to the of the spherical-planar intersection of the exemplary approximately triangular pick. This mating of the user's digit with the shape of the gripping contact area 40 results in a union that easily resists rotation because the top and bottom borders of the incurvate contact area 13 assist in maintaining the orientation of the plectrum within the user's grip.

FIGS. 5, 6, and 7, show cross-sectional views of three exemplary embodiments of the disclosure.

FIG. 5 displays a cross-sectional view of segment A-A (in FIG. 2) through the gripping contact area 40 of an exemplary relatively thinner plectrum 1. As shown in FIG. 2, segment A-A is transverse the base of the plectrum 1, across both legs of the plectrum, and a section of the gripping contact area 40. The first side (or reverse) of the plectrum relates the incurvate contact surface 13. In embodiments of the disclosure, the second side (or obverse) of the plectrum includes an obverse contact surface 35, having a convex aspect. With this exemplary embodiment, a region 37 of the gripping contact area 40 (that in embodiments may be as large as the gripping contact area 40, or smaller, and still embody the spirit of the disclosure), is presented with the same appropriate measurable dimension through its thickness as each plectrum (e.g., in a group of picks) of the disclosure, irrespective of the thickness of the string engaging areas. By implementing this aspect of the disclosure, a region 37 provides the user with a consistent dimensional reference between the gripping digits. One thinner string engaging area 5 at the base of the plectrum is present at the left side; one thinner string engaging area 25 at the base of the plectrum is present the right side.

FIG. 6 displays a cross-sectional view similar to FIG. 5, through the gripping contact area 40 of an exemplary relatively medium thickness plectrum 1'. As shown in FIG. 2, the first side (or reverse) of the plectrum relates the incurvate contact surface 13. In embodiments of the disclosure, the second side (or obverse) of the plectrum includes an obverse contact surface 35, having a convex aspect. With this exemplary embodiment a region 37 of the gripping contact area 40 (that in embodiments may be as large as the gripping contact area 40, or smaller, and still embody the spirit of the disclosure), is presented with the same appropriate measurable dimension through its thickness as each plectrum (e.g., in a group of picks) of the disclosure, irrespective of the thickness of the string engaging area. By implementing this aspect of the disclosure, a region 37 provides the user with a consistent dimensional reference of the measured thickness 30 between the gripping digits. One medium thickness string engaging area 5' at the base of the plectrum is present at the left side; one medium thickness string engaging area 25' at the base of the plectrum is present at the right side.

FIG. 7 displays a cross-sectional view similar to FIG. 5, through the gripping contact area 40 of an exemplary relatively thicker plectrum 1" (shown in FIG. 4). As shown in FIG. 2, the first side (or reverse) of the plectrum relates the incurvate contact surface 13. In embodiments of the disclosure, the second side (or obverse) of the plectrum includes an obverse contact surface 36, having a planar aspect. In this exemplary embodiment a region 37 of the gripping contact area 40 (that in embodiments may be as large as the gripping contact area 40, or smaller, and still embody the spirit of the disclosure), is presented with the same appropriate measurable dimension through its thickness as each plectrum (e.g., in a group of picks) of the disclosure, irrespective of the thickness of the string engaging area. By implementing this aspect of the disclosure, a region 37 provides the user with a consistent dimensional reference of the measured thickness 30 between the gripping digits. One thicker string engaging area 5" at the base of the plectrum is present at the left side; one thicker string engaging area 25" at the base of the plectrum is present at the right side.

A further aspect for embodiments of the present disclosure takes into consideration that the plectrum, regardless of contour, thickness, or material of manufacture, should provide a consistent dimensional reference in regards to the distance experienced between the digits that grip the plectrum through a region 37 of the gripping contact area 40. In this way the physically dynamic adjustments the user makes with the muscles and tendons of their gripping hand, when engaging a plectrum designed in adherence with the embodiments of the disclosure, do not need to be varied or adjusted to accommodate a plectrum that possesses different physical or material properties. As shown in FIG. 5, the exemplary embodiment of the measured thickness 30 in the gripping contact area 40 is thinner than both the edges at string engaging areas 5 and 25. In such a manner, embodiments of the disclosure allow the user to experience a familiar consistent thickness irrespective of the thickness of the string engaging areas. Referring to FIGS. 5, 6, and 7, the distance through an exemplary uniform measured thickness 30, from the surface of the obverse contact surface 35 to the surface of the incurvate contact surface 13, at least in the region 37, is approximately the same through FIG. 5, and FIG. 6, and FIG. 7.

With consideration that the average thickness of a pick is 0.72 mm, an aim of embodiments of the present disclosure is to provide across all variety of picks having different properties (e.g., thickness, flexibility, density, hardness, etc.) a consistent dimension experienced between the user's gripping digits. One could as easily make the distance experienced through the gripping contact area 40 in all iterations of the design offerings 4.00 mm as they could make it 0.10 mm and be true to the spirit of the disclosure. But a decision has to be made to commit to a particular thickness so that the player can benefit from a familiar, consistent, dimensional reference. With an exemplary embodiment, of the disclosure, a region 37 of the gripping contact area 40 will have a measured thickness 30 of approximately 0.72 mm. The resulting disclosure gripping contact area 40 (e.g., all of the gripping contact area 40, or some part of the gripping contact area 40) maintains the exemplary 0.72 mm dimension through various iterations of picks (e.g., plectra having different string engaging area thicknesses), so that a plectrum with a string engaging area that is 0.80 mm thick would have the same measured thickness 30 of 0.72 mm through a region 37 of the gripping contact area 40, as would a plectrum with a string engaging area that is 2.00 mm thick. The consistent dimensional reference (in this exemplary embodiment 0.72 mm) experienced by the gripping digits results in the player being as comfortable holding the 2.00 mm plectrum as he or she is holding a 0.80 mm plectrum due to the users muscles and tendons being in the same relative position. As should be understood, while embodiments reference a pick having a 0.72 mm thickness within the gripping contact area 40, the disclosure could equally be practiced with different thicknesses (e.g., 0.80 mm, 1.2 mm, 0.54 mm) for example, on a custom-made basis.

Figure 8:
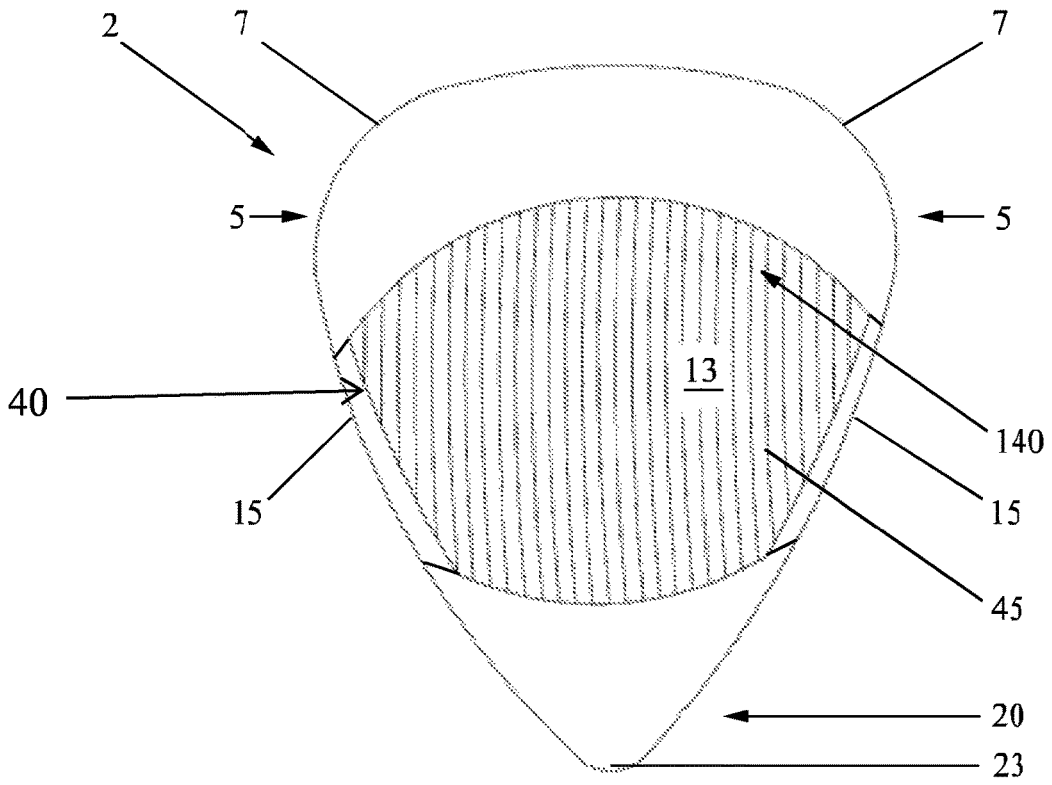
FIG. 8 is a plan view of the reverse side of another exemplary plectrum displaying the incurvate contact surface and having a textured surface feature in accordance with aspects of embodiments of the disclosure.

FIG. 8 is a plan view of the reverse side of another exemplary plectrum 2 displaying the incurvate contact surface 13, and having a textured surface feature 140. In embodiments, exemplary plectrum 2 includes a textured surface feature 140 that is not fully extending to the edge profile 15 of the spherical-planar intersection. In embodiments, the textured surface feature 140 can be made to extend to the profile 15 of the spherical-planar intersection, but the presence of a texture near to, or on, a string engaging area may scrape, catch, or snag a string being engaged and produce an unwanted tonal artifact. The exemplary plectrum 2 includes two string engaging areas 5, each with a broader radius 7 at the base of the plectrum, and a string engaging area 20 with a narrower radius 23 at the vertex of the plectrum. The location of the profile 15 of the spherical-planar intersection that, in embodiments resembles a platykurtic data distribution curve, is at both sides of the exemplary triangular plectrum, the result of the gripping contact area 40 having been arranged on and extended to the edges of the plectrum.

Figure 9:
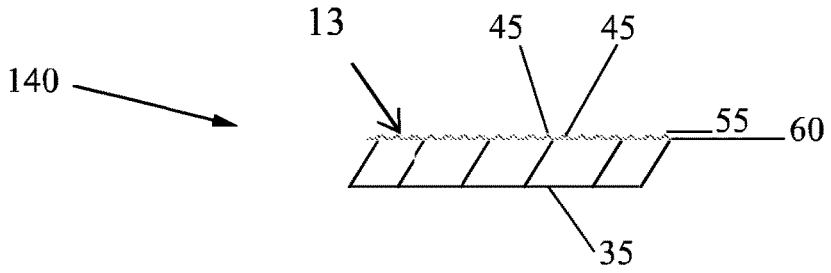
FIG. 9 is a cross-sectional view of an exemplary embodiment of a textured surface feature, showing ridged texture elements rising up from the surface of the reverse side contact surface in accordance with aspects of embodiments of the disclosure.

FIG. 9 is a cross-sectional view of an exemplary embodiment of a textured surface feature 140, showing a fingerprint ridge engaging element 45 rising up from the surface 60 of a contact area of the pick (e.g. an incurvate contact surface 13 and/or obverse contact surface 35) to a peak 55 of a fingerprint ridge engaging element 45. It should be noted that the exemplary pick is depicted as planar in FIG. 9 in order to more clearly illustrate the textured surface feature 140, and that the disclosure contemplates, the textured surface feature 140 may be formed on the incurvate contact surface 13. An exemplary spacing is displayed between one fingerprint ridge engaging element 45 and an adjacent fingerprint ridge engaging element 45. With this exemplary embodiment, the textured surface feature 140 is structured and arranged on the incurvate contact surface 13 and the obverse contact surface 35 of the cross-section is noted for orientation purposes.

Referring to FIGS. 8 and 9, a further aspect for embodiments of the present disclosure utilizes the ergonomically efficient textured surface feature 140 to provide, ensure, or assist a surface that engages well with a user's gripping digits.

The human fingerprint ridge has an average ridge-to-ridge distance of approximately 0.50 mm+/−0.35 mm, and an average height of approximately 0.07 mm+/−0.04 mm. A textured surface feature 140 that mimics or addresses these, or multiples of these, or dividends of these dimensions, in distance, between one fingerprint ridge engaging element 45 and an adjacent fingerprint ridge engaging element 45, and in height, rising up from the surface 60 of a contact area to the peak 55 of a fingerprint ridge engaging element, provides a very efficient gripping surface for the user, especially when the pattern elements are oriented to align with the typical placement of the user's fingerprint inter-ridge spaces.

Efficacy of a fingerprint ridge engaging element in engaging the fingerprint ridges is greatly diminished if the width of the engaging element of the texture is made too wide to fit between fingerprint ridges. The ideal height of an engaging element of the texture in place between fingerprint ridges will allow the top of the fingerprint ridges to come in contact with the surface from which the texture rises. When the engaging element of the texture is too tall, the top of the fingerprint ridge is taken out of a touching relationship with the surface from which the texture rises, and the engaging efficacy of the of the texture is greatly reduced. When the height of the engaging element of the texture is lowered, however, engaging efficacy remains relatively unchanged until the point where the element height is so low as to be tactilely imperceptible to the digit, therein becoming ineffective. Periodicity of the engaging element does not have to engage every fingerprint ridge to be effective. For example, patterns which only couple the texture element to every second, third, fourth, fifth, or even sixth of the user's fingerprint ridge valleys have been found to provide an improved effective gripping texture.

In the exemplary embodiment, whether situated on the reverse side displaying the incurvate contact surface, or on the obverse side which may display some prominence of the suitably conveyed convex contact surface, or on both sides, the engagement pattern may be most effective when the textured surface feature 140 is oriented parallel to the anticipated fingerprint orientation. Finger and thumb-print ridge orientation is transverse at the distal end of the digit. In the exemplary embodiment, a linear patterned textured surface feature 140 is oriented parallel to an imaginary line that runs from the narrower radius 23 string engaging area at the vertex of the plectrum 1 to the mid-point of the base of the pick. In this way, the fingerprint ridges lock into the textured surface feature 140 when digital force is applied perpendicular to the oriented pattern. While the present disclosure describes an exemplary pattern, the disclosure contemplates any pattern placement that aligns pattern orientation with anticipated fingerprint ridge orientation.

A further aspect for embodiments of the present disclosure takes into consideration that the plectrum should be capable of being gripped in a manner of ways that accommodate the players' style, habit, and/or tradition, without dictating where the player should engage the pick to realize the benefits of design.

Figure 14:
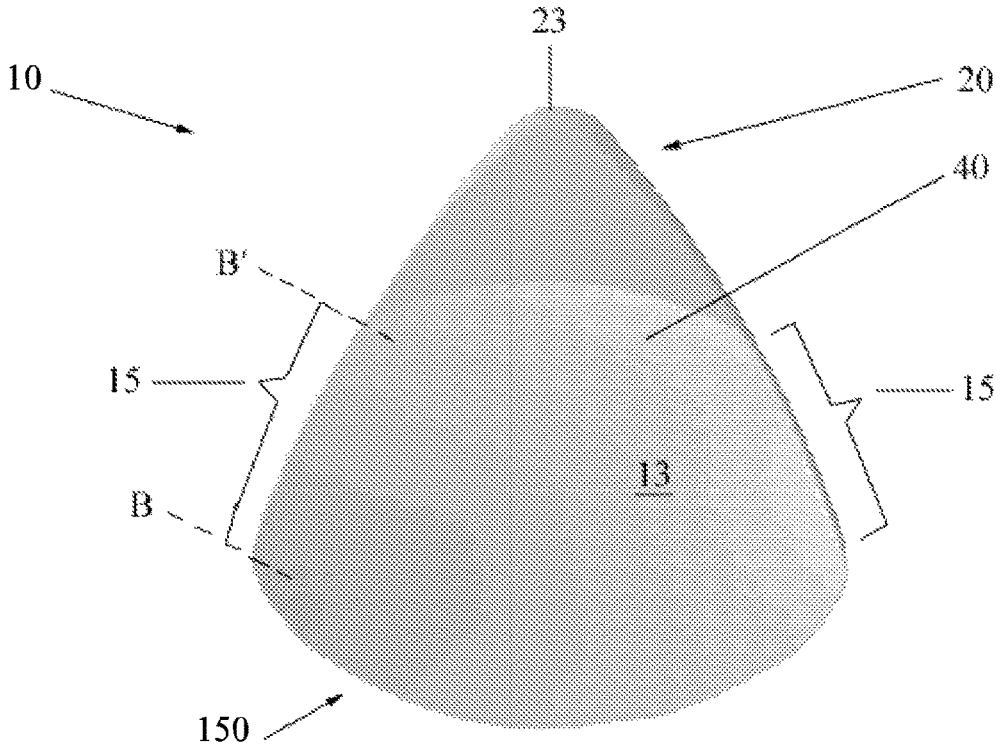
FIG. 14 is a plan view of the reverse side of an exemplary plectrum, featuring one string engaging area, and providing an exemplary finger contact area which provides freedom of finger placement in 3 directions, in accordance with aspects of embodiments of the disclosure.

Referring to FIG. 14, in embodiments of the disclosure 10, a suitable shape is conveyed to the gripping contact area 40 so that the boundaries of the widest part of the curves, instead of being within the confines of the perimeter of the pick, intersect the perimeter of the pick through its thickness. The gripping contact area 40 may be structured and arranged about the median of the sides, and may extend to the base of the exemplary triangular plectrum, resulting in a profile 15, that allows one to freely couple, within 3 directions of freedom, to anywhere on the gripping contact area 40 that is most comfortable to the user. These exemplary embodiments display a string engaging element 20 at the apex of the exemplary triangular pick. The only physical limitation presented to preferred finger placement within the structure of the exemplary pick is a border between the string engaging element and the gripping contact area.

Figure 15:
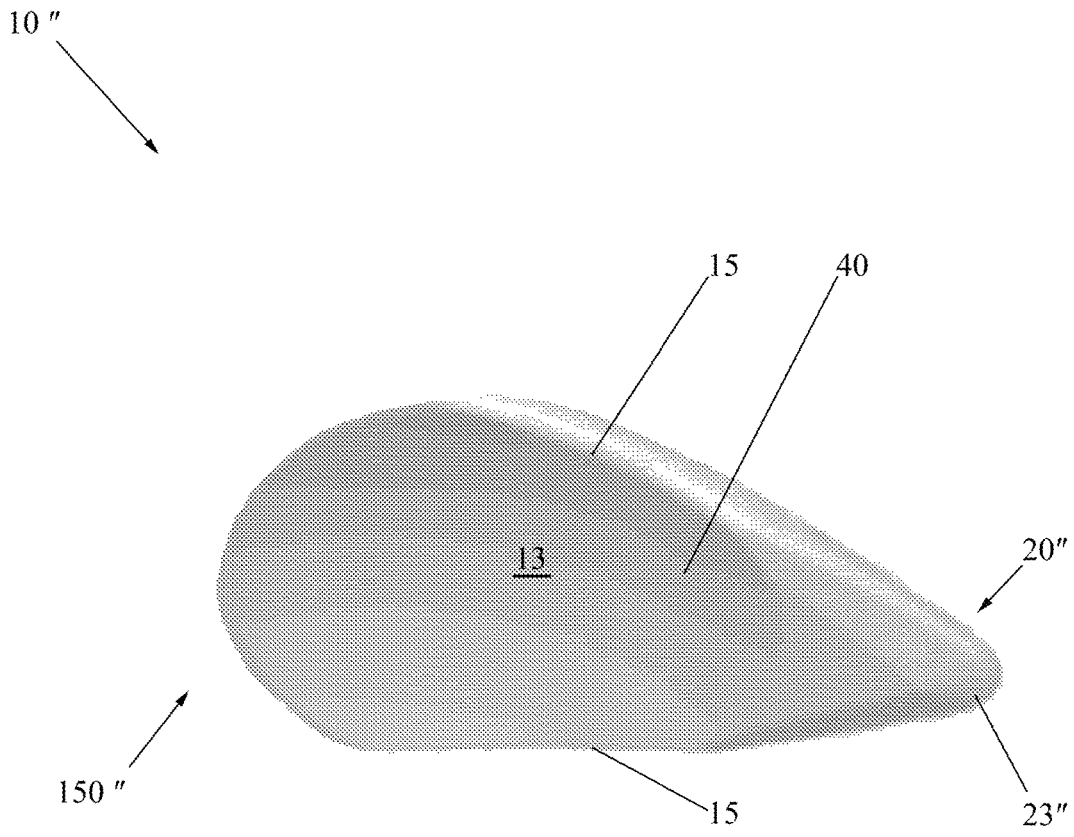
FIG. 15 is an alternative perspective view of the reverse side of an exemplary thicker plectrum, featuring one string engaging area, and providing an exemplary contact area which provides freedom of finger placement in 3 directions, in accordance with aspects of embodiments of the disclosure.

Referring to FIG. 15, in embodiments of the disclosure 10", a suitable shape is conveyed to the gripping contact area 40 so that the boundaries of the widest part of the curves, instead of being within the confines of the perimeter of the pick, intersect the perimeter of the pick through its thickness. The gripping contact area 40 may be structured and arranged about the median of the sides, and may extend to the base of the exemplary triangular plectrum, resulting in a profile 150, that allows one to freely couple, within 3 directions of freedom, to anywhere on the gripping contact area 40 that is most comfortable to the user. These exemplary embodiments display a string engaging element 20" at the apex of the exemplary triangular pick. The only physical limitation presented to preferred finger placement within the structure of the exemplary pick is a border between the string engaging element and the gripping contact area.

Physical borders of conventional picks with gripping features guide fingers to the center of the pick where the feature is arranged. With a hard boundary, the feature is centrally located, such that the feature is surrounded by a planar portion of the pick on all side of the feature. With such a centrally located feature, the entire perimeter of the pick lies in a common plane. In accordance with embodiments of the disclosure, the player will find no directing borders within the range of freedom desired. The player already knows where they want to go, and it is probably not to the center of the pick. By removing the borders that are aligned with the range of freedom the player is seeking, the player will perceive the plectrum as being comfortable and accommodating to him or her because the embodiments allow the fingers to couple to anywhere on the gripping contact area 40 without being directed by a border associated with the gripping contact area 40 range. In accordance with aspects of embodiments of the disclosure, this may be accomplished by controlling the width and/or depth of the impression of the gripping contact area 40. When the impression is too narrow, a shelf, or border is created from the edge of the impression extending outward to the perimeter of the pick, such that the pick has a planar perimeter, in which the entire perimeter has a common plane. The effect upon the player is guidance towards the center of the pick where the feature is located. That may be ideal for some players, but most players' finger placement ideal lies somewhere else. Embodiments of the disclosure may or may not have a shelf (e.g., a planar border from the edge of the impression extending outward to the perimeter of the pick). A user's digits can couple through the range of freedom desired more efficiently when, if present, the shelf, or border, created from the edge of the impression extending outward to the perimeter of the pick is less prominent. Embodiments are directed towards the pick having no shelf, but the disclosure contemplates that the pick may have one. In embodiments, the absence of a shelf is ideal.

Referring to FIGS. 1, 2, 3 and 4, in embodiments of the disclosure, a suitable shape is conveyed to the gripping contact area 40 so that the boundaries of the widest part of the curves, instead of being within the confines of the perimeter of the pick, intersect the perimeter of the pick through its thickness. In embodiments, the gripping contact area 40 may be structured and arranged about the median of the sides of the exemplary triangular plectrum, resulting in a profile 15 between the spherical-planar intersections (between B and B') that resembles, in one exemplary plectrum, a platykurtic data distribution curve. In another embodiment, a suitable shape is conveyed upon the gripping contact area 40 to resemble the same relative radii as that across the conjugate axis of the distal end of a human digit. In accordance with embodiments of the disclosure, the profile 15, between the spherical-planar intersections, acts as a feature that is non-directive in its ability to guide an engaging digit, allowing the digit a range of freedom of movement, freely able to couple anywhere on the gripping contact area 40 most comfortable to the user. An upper perimeter exists on the obverse of the plectrum, and a lower perimeter exists on the reverse of the plectrum. One perimeter, or both, may have a region, or regions, that are not coplanar.

A further aspect for embodiments of the present disclosure is to keep the string engaging areas 5, 20, and 25 between the fingers in plane with expectations, given that flat picks have been the standard by which most players have come to experience a pick.

An additional aspect for embodiments of the present disclosure takes into consideration that optimal positioning of the gripping contact area 40 may render one or more of the co-planar string engaging areas 5, 20, and 25 non-contiguous with one another.

Consider this exercise. Extend an index finger and thumb then bring them together, the pads of each touching one another. One will observe that a line is created where they meet. The brain and body extrapolate where an imaginary extension of that line would point to. In the case of the plectrum, the brain expects that a string in need of engagement will be at the end of that line, some distance from the end of the fingers. This, in accordance with aspects of embodiments of the disclosure, the string engaging areas 5, 20, and 25 may be coplanar in order to maintain user's positional expectations, in relationship to the gripping digits, of where the string is expected to be. However, since an incurvate gripping contact area 40 has been introduced to the plane of the standard pick, a discontinuity of the plane is present, and at least one plane of the string engaging areas 5, 20, and 25 has been rendered non-contiguous to the other string engaging areas.

In embodiments, exemplary manufacturing methods include, but are not limited to: molding methods (including but not limited to: plastic-injection molding, and metal-injection molding); additive manufacturing methods (including but not limited to: 3-D printing, stereo lithography, sintering, laminated object manufacturing); casting; single and multi-axis subtractive machining methods, whether manual, numerically controlled, or computer numerically controlled (including but not limited to: filing, turning, milling, drilling, electro discharge machining, and grinding. Exemplary manufacturing methods may also include, but are not limited to: forming-based manufacturing methods (including but not limited to: stamping, pressing, coining, and forging; hard and machine carving, among other methods.

In embodiments, exemplary suitable materials that may be used to manufacture embodiments of the disclosure include materials capable of being fashioned in accordance with the embodiments of the disclosure, including but not limited to: metals (including but not limited to: copper and its alloys, silver and its alloys, aluminum and its alloys, titanium and its alloys); plastics, polymers and co-polymers thereof (including but not limited to thermoplastics, such as but not limited to: acrylic, nylon, polyethylene, polyoxymethylene, polystyrene, polypropylene, polybenzimidazole, poly vinyl chloride, cellulose-based plastics); thermoset plastics (such as but not limited to: polyurethanes, phenol-formaldehyde resin, Polyester resin, Epoxy resin); and/or natural materials (such as but not limited to: stone, bone, horn, wood, shell, glass, leather, felt, and/or rubber).

Referring again to FIG. 2, a further aspect for embodiments of the present disclosure takes into consideration that multiple string engaging areas 5, 20, 25 may be provided on the same plectrum 1 in combination with the gripping contact area 40. These string engaging areas may vary by dimension of radius, or frequency of appearance along a section of the perimeter of the plectrum. Acknowledging the fact that the embodiments may be applied to an innumerable variety of combinations of profiles, an exemplary embodiment plectrum 1 is presented having string engaging area 5 with a broader radius 7 at the base of the plectrum, and a string engaging area 20 with a narrower radius 23 at the vertex of the plectrum 1 (similar to the 351 pick). However, string engaging area 25 includes a plurality of sequential bumps 29 arranged along the perimeter arc of the base corner of the plectrum 1. In accordance with aspects of the disclosure, string engaging area 25 may be used to (via sequential bumps 29) simulate a twelve string guitar effect by striking the strings multiple times per pass of the plectrum.

A further aspect for embodiments of the present disclosure addresses the manufacturers need to communicate how the plectrum is expected to behave relative to other plectrums whose design embodies aspects of the present disclosure. Conventionally, pick flexibility has been communicated by a declaration of a thickness (e.g. contiguous thickness) of the pick. By offering multiple embodiments of the disclosure made with various materials of specific and differing physical and performance characteristics, a manufacturer can easily present a practical array of plectra in the hopes that some iteration will be exactly what any given player is looking for. A method for communicating such information utilizes language that efficiently and objectively compares the performance characteristics of each embodiment. Referring to FIGS. 10, 11, 12 and 13, an exemplary embodiment depicting an indication system for identifying and comparing the physical and performance characteristics in accordance with aspects of embodiments of the disclosure may be accomplished using declarative language to communicate information about relative density, hardness, flexibility, and appearance amongst other properties. For example, the material indicated in FIG. 10, has High Density 73, High Hardness 83, and Medium Flexibility 92, the material indicated in FIG. 11, has High Density 73, Low Hardness 81, and High Flexibility 93, the material indicated in FIG. 12, has Medium Density 72, Medium Hardness 82, and Medium Flexibility 92, and the material indicated in FIG. 13, has Medium Density 72, High Hardness 83, and Medium Flexibility 92, a player currently using a plectrum made of material A, FIG. 10, who wants the same hardness and flexibility but needs more density, can, through comparison, purchase a plectrum made from material D, FIG. 13. This system of language, used in concert with a declaration regarding the appearance of a given material, is an incredibly effective communication tool.

Figure 10:
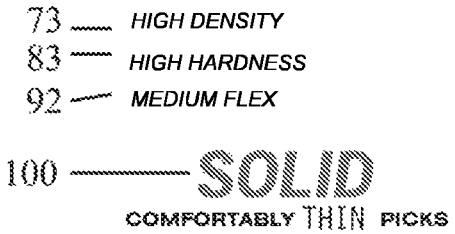
FIG. 10 is exemplary packaging depiction displaying an indication system for identifying and comparing the physical and performance characteristics in accordance with aspects of embodiments of the disclosure.
Figure 11:
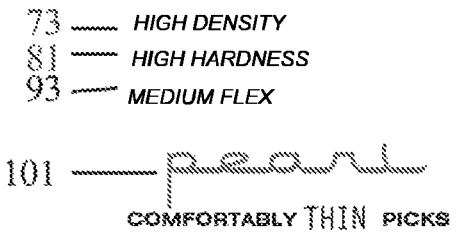
FIG. 11 is exemplary packaging depiction displaying an indication system for identifying and comparing the physical and performance characteristics in accordance with aspects of embodiments of the disclosure.
Figure 12:
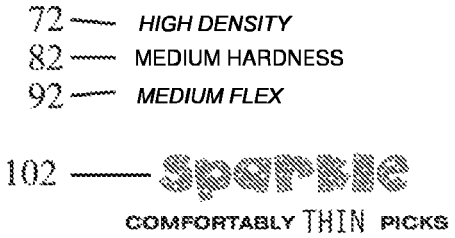
FIG. 12 is exemplary packaging depiction displaying an indication system for identifying and comparing the physical and performance characteristics in accordance with aspects of embodiments of the disclosure.
Figure 13:
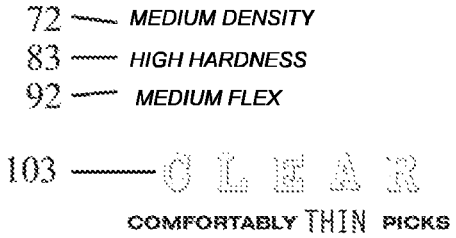
FIG. 13 is exemplary packaging depiction displaying an indication system for identifying and comparing the physical and performance characteristics in accordance with aspects of embodiments of the disclosure.

In accordance with further aspects of the disclosure, a pick utilizing an associated name based on its outward physical appearance, for example, the pick illustrated in FIG. 10 (e.g., made of Material A), has been given the physical attribute of appearing opaque, or SOLID 100, so the term SOLID 100 is the associated with the characteristics of High Density 73, High Hardness 83, and Medium Flexibility 92. The pick illustrated in FIG. 11 (e.g., made of Material B), has been given the physical attribute of appearing pearlescent, so the term PEARL 101 is associated with the characteristics of High Density 73, Low Hardness 81, and High Flexibility 93. The pick illustrated in FIG. 12 (e.g., made of Material C), has been given the physical attribute of being semi-transparent with glitter suspended within, so the term SPARKLE 102 is associated with the characteristics of Medium Density 72, Medium Hardness 82, and Medium Flexibility 92. The pick illustrated in, FIG. 13 (e.g., made of Material D), has been given the physical attribute of being transparent with a colored tint, so the term CLEAR 103 is associated with the characteristics of Medium Density 72, High Hardness 83, and Medium Flexibility 92. This indicating system, while described in the context of stringed instrument picks, is infinitely more informative that the current convention and use of its novelty can be applied across all aspects of business communication, including but not limited to packaging, promotion, labeling, advertising, decoration, multimedia, education, training, and/or marketing.

As used herein, the term 'suitable' when describing a geometric solid shape that can be used to provide to either the incurvate contact surface, or the the obverse contact surface, which may be a convex relief, includes: any geometric solid shape composed of non-degenerate real quadric surfaces, any platonic geometric solid shape that is primarily spheroid in nature, any Archimedean geometric solid shape that is primarily spheroid in nature, and any other solid forms, be they simple or compound, capable of providing an impression that respects the spirit of the disclosure. Illustrated embodiments of the disclosure present a Prolate Spheroid as a suitable geometric solid shape for use in forming the incurvate contact surface, not as a limitation, but as an exemplary embodiment of the disclosure.

While the disclosure has been described with reference to specific embodiments, those skilled in the art will understand that various changes may be made and equivalents may be substituted for elements thereof without departing from the true spirit and scope of the disclosure. In addition, modifications may be made without departing from the essential teachings of the disclosure. For example, with reference to FIG. 2, while the plectrum is depicted as having at least two string-engaging areas, the disclosure contemplates a plectrum only having a single string-engaging area (e.g., string engaging areas 20) in combination with the incurvate contact surface 13 and the gripping contact area 40. In such an embodiment, the incurvate contact surface 13 (or the gripping contact area 40) would at least partially define three boundary edges of the plectrum (i.e., at least portions of the two side edges 15, and the edge opposite the string-engaging area 20).

What is claimed is:

1. A musical instrument plectrum having a first side, a second side and a perimeter edge, the plectrum comprising:
- at least two string-engaging regions;
- an incurvate finger contact surface on the first side of the plectrum;
- an obverse finger contact surface on the second side of the plectrum; and
- a spheroidal-planar intersection at one or more portions of the perimeter edge of the plectrum,
- wherein the incurvate finger contact surface is structured and arranged so that two of the at least two string-engaging regions are noncontiguous with each other.

2. The musical instrument plectrum according to claim 1, wherein a shape of the obverse finger contact surface corresponds with a shape of the incurvate finger contact surface.

3. The musical instrument plectrum according to claim 2, wherein the obverse finger contact surface has approximately the same shape as that of the incurvate finger contact surface.

4. The musical instrument plectrum according to claim 2, wherein the obverse finger contact surface has approximately a same radius of curvature as that of the incurvate finger contact surface.

5. The musical instrument plectrum according to claim 1, wherein the obverse finger contact surface extends beyond a planar surface of the at least two string-engaging regions on the second side of the plectrum.

6. The musical instrument plectrum according to claim 1, wherein the obverse finger contact surface is a planar surface coplanar with surfaces of the at least two string-engaging regions on the second side of the plectrum.

7. The musical instrument plectrum according to claim 1, wherein the incurvate finger contact surface on the first side of the plectrum extends to side edges of the plectrum.

8. The musical instrument plectrum according to claim 1, wherein portions of the perimeter edge of the plectrum are not co-planar with remaining portions of the perimeter edge of the plectrum.

9. The musical instrument plectrum according to claim 1, wherein the spheroidal-planar intersection at one or more portions of the perimeter edge of the plectrum is formed by the intersection of the incurvate finger contact surface on a first side of the plectrum with two of the at least two string-engaging regions.

10. The musical instrument plectrum according to claim 1, further comprising a curved profile at one or more portions of the perimeter edge of the plectrum.

11. The musical instrument plectrum according to claim 1, wherein the obverse finger contact surface comprises a convex shape.

12. The musical instrument plectrum according to claim 1, further comprising a textured surface feature comprising a plurality of fingerprint ridge engagement elements, a height of which approximates an average fingerprint ridge depth.

13. The musical instrument plectrum according to claim 12, wherein the plurality of fingerprint ridge engagement elements are spaced from one another as a multiple or divisional of an average human fingerprint ridge-to-ridge distance.

14. The musical instrument plectrum according to claim 12, wherein the plurality of fingerprint ridge engagement elements are aligned parallel to a longitudinal axis of the plectrum.

15. The musical instrument plectrum according to claim 12, wherein the plurality of fingerprint ridge engagement elements are aligned parallel to a fingerprint orientation.

16. The musical instrument plectrum according to claim 1, wherein the at least two string-engaging regions are planar regions.

17. A method of making the musical instrument plectrum according to claim 1, the method comprising forming the musical instrument plectrum in a mold that is structured and arranged to form the incurvate finger contact surface on the first side of the plectrum.

18. A plurality of musical instrument plectrums each having a first side, a second side and a perimeter edge, each musical instrument plectrum comprising:
- at least two string-engaging regions;
- an incurvate finger contact surface on the first side of the plectrum;
- an obverse finger contact surface on the second side of the plectrum;
- a spheroidal-planar intersection at one or more portions of the perimeter edge of the plectrum;
- the incurvate finger contact surface and the obverse finger contact surface together forming gripping contact areas; and
- a thickness between the incurvate finger contact surface and the obverse finger contact surface in a region of gripping contact areas, wherein the incurvate finger contact surface is arranged so that two of the at least two string-engaging regions are noncontiguous with each other, wherein each of the plurality of musical instrument plectrums has differing structural characteristics, wherein the differing structural characteristics comprise different plectrum thicknesses of one or more of the string engaging areas of the respective plectrums, and wherein the thickness in the region of gripping contact area is the same for each of the plurality of musical instrument plectrums.

19. The plurality of musical instrument plectrums according to claim 18, wherein the differing structural characteristics additionally comprise different materials of the respective plectrums.

20. The plurality of musical instrument plectrums according to claim 18, wherein the differing structural characteristics additionally comprise different stiffnesses of the respective plectrums.

21. A musical instrument plectrum having a first side, a second side and a perimeter edge, the musical instrument plectrum comprising:

at least one string-engaging region;

an incurvate finger contact surface on the first side of the plectrum, wherein the incurvate finger contact surface on the first side of the plectrum extends to portions of the perimeter edge of the plectrum, and a spheroidal-planar intersection at one or more portions of the perimeter edge of the plectrum, such that the one or more portions of the perimeter edge of the plectrum are not co-planar with remaining portions of the perimeter edge of the plectrum.

22. The musical instrument plectrum according to claim 1, wherein at least one border of the incurvate finger contact surface extends to portions of the perimeter edge of the plectrum so that the incurvate finger contact surface is non-directive in its ability to guide the gripping digits.

23. The musical instrument plectrum according to claim 1, wherein at least one border of the incurvate finger contact surface extends to portions of the perimeter edge of the plectrum such that the incurvate finger contact surface accommodates multiple positions of a gripping digit within the incurvate finger contact surface including locating the gripping digit at one or more portions of the perimeter edge of the plectrum.

24. A musical instrument plectrum having a first side, a second side and a perimeter edge, the plectrum comprising:

at least two string-engaging regions;

an incurvate finger contact surface on the first side of the plectrum;

an obverse finger contact surface on the second side of the plectrum; and a textured surface feature comprising a plurality of fingerprint ridge engagement elements, a height of which approximates an average fingerprint ridge depth, wherein the incurvate finger contact surface is structured and arranged so that two of the at least two string-engaging regions are noncontiguous with each other, and wherein the plurality of fingerprint ridge engagement elements are aligned parallel to a longitudinal axis of the plectrum.

* * * * *